US007562718B1

(12) United States Patent
Moorman et al.

(10) Patent No.: US 7,562,718 B1
(45) Date of Patent: Jul. 21, 2009

(54) LOCKING MECHANISM FOR MOUNTING A PLOW TO A VEHICLE

(75) Inventors: Scott Moorman, Concord, OH (US); Andrew Webb, Conneaut, OH (US); James A. Bala, Wickliffe, OH (US); Timothy Bunsey, South Russell, OH (US)

(73) Assignee: Buyers Products Company, Mentor, OH (US)

( * ) Notice: Subject to any disclaimer, the term of this patent is extended or adjusted under 35 U.S.C. 154(b) by 0 days.

(21) Appl. No.: 12/039,852

(22) Filed: Feb. 29, 2008

(51) Int. Cl.
*A01B 59/06* (2006.01)
*E02F 3/36* (2006.01)

(52) U.S. Cl. ..... 172/272; 37/468; 414/723

(58) Field of Classification Search ..... 37/231, 37/232, 468, 906; 414/723, 724, 912; 172/272, 172/273; 403/322, 324, 325
See application file for complete search history.

(56) References Cited

U.S. PATENT DOCUMENTS 3,876,091 A * 4/1975 MacDonald ..... 414/723
4,030,624 A * 6/1977 Matthews ..... 414/723
4,619,060 A 10/1986 Knowlton
4,962,599 A 10/1990 Harris
5,014,452 A * 5/1991 Berghefer ..... 37/235
5,082,065 A 1/1992 Fletcher
5,111,603 A 5/1992 Knowlton et al.
5,419,673 A * 5/1995 Merhar ..... 414/723
5,568,694 A 10/1996 Capra et al.
5,590,483 A * 1/1997 Kim ..... 37/468
5,685,689 A * 11/1997 Schneider et al. ..... 414/723
5,692,855 A * 12/1997 Burton ..... 403/325
6,012,240 A 1/2000 Klug et al.
6,615,513 B2 9/2003 Quenzi et al.
6,618,965 B1 9/2003 Schultz et al.
6,928,757 B2 8/2005 Bloxdorf et al.
6,941,685 B2 9/2005 Goy et al.
7,117,617 B2 10/2006 Kost et al.
7,146,754 B2 12/2006 Schultz et al.

* cited by examiner

*Primary Examiner*—Robert E Pezzuto
(74) *Attorney, Agent, or Firm*—Kusner & Jaffe

(57) ABSTRACT

A coupling for a plow comprising a push beam attachable to a front of a vehicle. The push beam has at least one outwardly-extending plate at each end thereof. Each plate has an aperture extending therethrough. A support frame is provided that is attachable to the back side of a plow assembly. The support frame has two spaced-apart plates extending therefrom, each of the plates having an aperture therethrough. The plates are dimensioned to be positioned adjacent the plates on the push beam with the apertures in the plates being aligned. A locking assembly is provided for locking the support frame to the push beam. The locking assembly is comprised of a pair of axially aligned pins biased outwardly away from each other. Each of the pins has an inner end and an outer end. A linkage connects the inner ends of the pins. The linkage has a first position wherein the pins are retracted toward each other along the axis, and a second position wherein the pins extend outwardly away from each other along the axis.

15 Claims, 6 Drawing Sheets

LOCKING MECHANISM FOR MOUNTING A PLOW TO A VEHICLE

FIELD OF THE INVENTION

The present invention relates generally to plow assemblies for attachment to a vehicle and, more particularly, to a locking mechanism for easily mounting and removing a plow assembly to the front of a vehicle.

BACKGROUND OF THE INVENTION

The present invention relates to a plow assembly for attachment to vehicles, such as light-duty and medium-duty trucks and suburban-utility vehicles (SUVs). A plow assembly is typically attached to a push bar assembly that is fixedly secured to a frame or chassis of the vehicle. Typically, holes on the plow assembly are horizontally and vertically aligned with corresponding holes on the push bar assembly, and pins are inserted into the aligned holes to secure the plow assembly to the push bar assembly. Such pin connections between the plow assembly and the push bar assembly allow for attachment and detachment of the plow assembly from the push bar assembly.

The present invention provides a novel and unique locking mechanism for forming a pin connection between a plow assembly and a push bar assembly.

SUMMARY OF THE INVENTION

In accordance with a preferred embodiment of the present invention, there is provided a locking assembly for locking a plow onto a push beam on a vehicle. The push beam has two spaced-apart receiver plates extending therefrom, the receiver plates each having an aperture therethrough. The locking assembly is comprised of a mounting frame that is attachable to the back side of a plow assembly. The mounting frame has spaced-apart mounting plates with apertures therethrough. The mounting plate is designed to be positioned adjacent to the receiver plates with the apertures in a receiver plate in vertical and horizontal alignment with a mounting plate. A locking mechanism is provided for locking the mounting frame to the push beam. The locking assembly has a pair of axially-aligned, spaced-apart locking pins biased outwardly away from each other along a first axis. Each locking pin has an inner and an outer end. A linkage is connected to the inner ends of the locking pins. The linkage is movable between a first position and a second position and is operable to simultaneously move the locking pins along an axis. The pins are in a retracted position along the axis when the linkage is in the first position, and are in an extended position along the axis when the linkage is in the second position. Each of the locking pins extends through the apertures in a receiving plate and a mounting plate when the aperture in a receiving plate and a mounting plate are horizontally and vertically aligned and when the linkage is in the second position. Each of the locking pins is removed from the apertures when the linkage is in the first position.

In accordance with another embodiment of the present invention, there is provided a coupling for a plow comprising a push beam attachable to a front of a vehicle. The push beam has at least one outwardly-extending plate at each end thereof. Each plate has an aperture extending therethrough. A support frame is provided that is attachable to the back side of a plow assembly. The support frame has two spaced-apart plates extending therefrom, each of the plates having an aperture therethrough. The plates are dimensioned to be positioned adjacent the plates on the push beam with the apertures in the plates being aligned. A locking assembly is provided for locking the support frame to the push beam. The locking assembly is comprised of a pair of axially aligned pins biased outwardly away from each other. Each of the pins has an inner end and an outer end. A linkage connects the inner ends of the pins. The linkage has a first position wherein the pins are retracted toward each other along the axis, and a second position wherein the pins extend outwardly away from each other along the axis.

An advantage of the present invention is a new and improved plow assembly that can be easily connected and disconnected from a vehicle.

Another advantage of the present invention is a plow assembly as described above that quickly and simply connects and disconnects to and from a vehicle.

Another advantage of the present invention is a snow plow assembly as described above that includes a locking mechanism to maintain a snow plow in an attached position relative to a vehicle.

Another advantage of the present invention is a snow plow assembly as described above wherein the locking mechanism includes locking pins for locking the snow plow assembly to the push bar assembly.

A still further advantage of the present invention is a snow plow assembly as described above wherein the locking mechanism is disposed internal to the snow plow assembly where the locking mechanism is less susceptible to damage from contact with external objects during use of the plow assembly.

A still further advantage of the present invention is a snow plow assembly as described above wherein the locking mechanism is operable by a single operator from one side of the plow assembly.

A still further advantage of the present invention is a snow plow assembly as described above wherein the locking pins are mechanically connected to each other.

A still further advantage of the present invention is a snow plow assembly as described above wherein the locking pins move simultaneously between a locking position and an unlocking position.

A still further advantage of the present invention is a snow plow assembly as described above wherein the locking pins are biased to a locking position.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
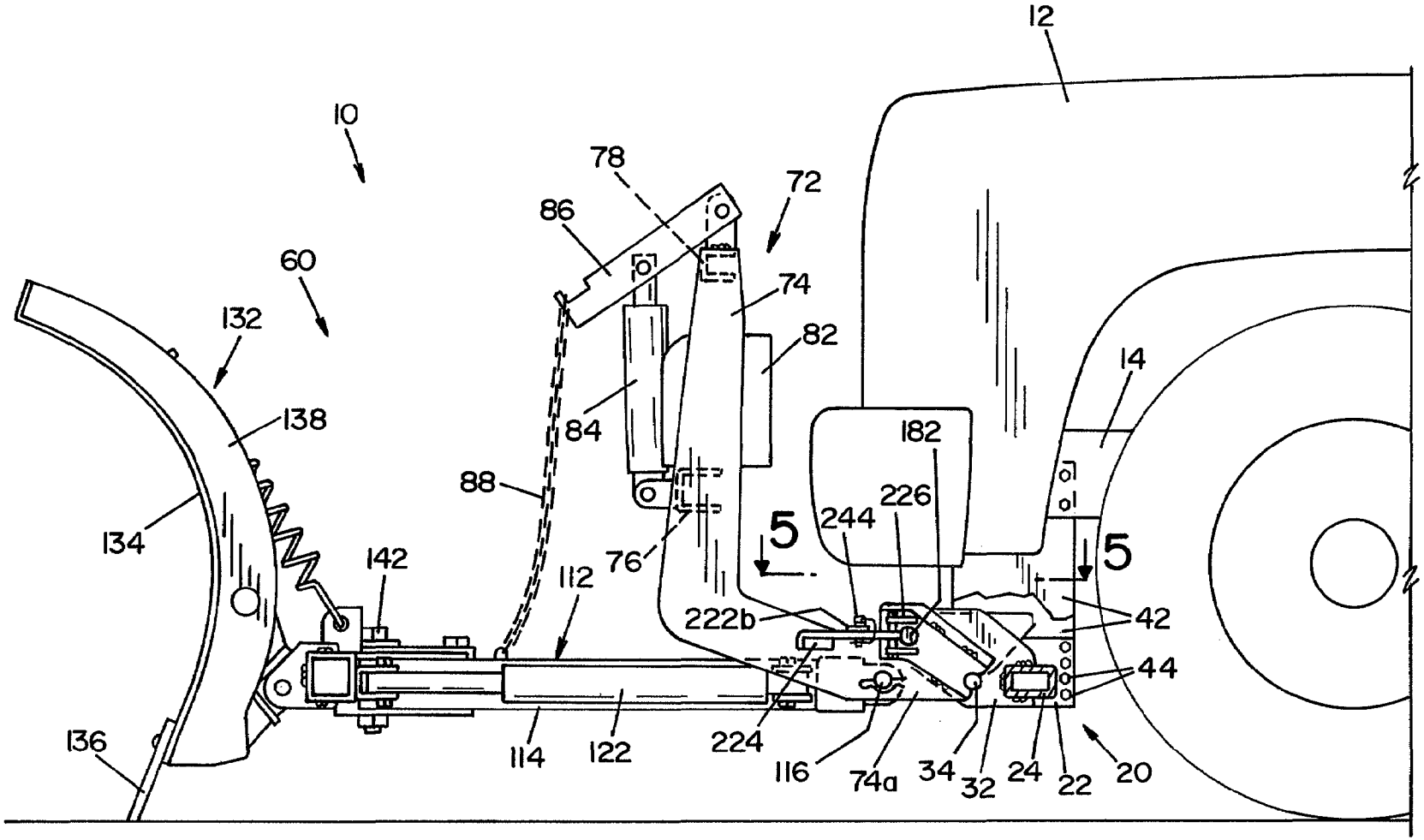
FIG. 1 is a side elevational view of a snow plow and mount assembly attached to a vehicle.
Figure 2:
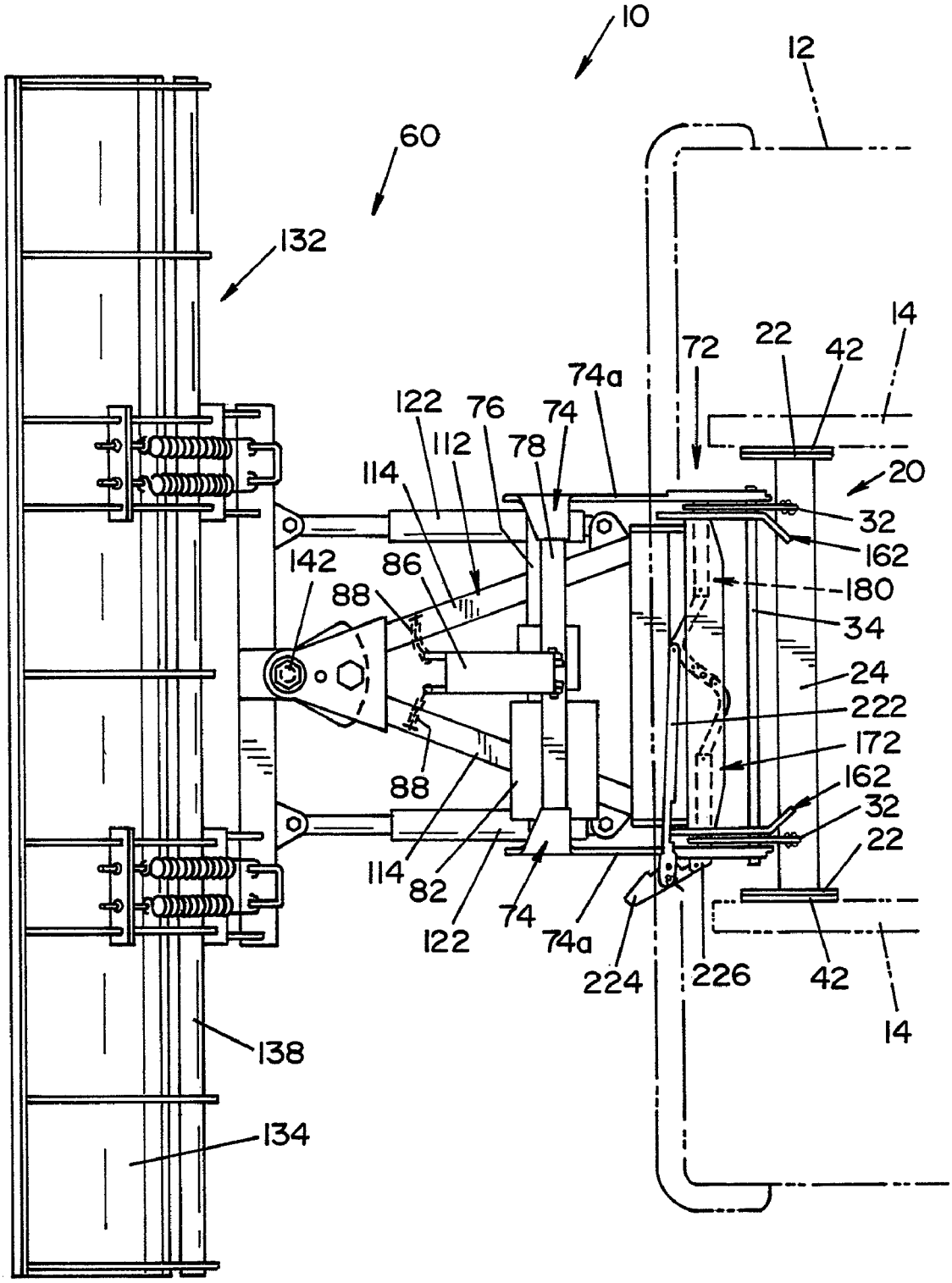
FIG. 2 is a top plan view of the snow plow and mount assembly shown in FIG. 1.

Referring now to the drawings wherein the showing is for the purpose of illustrating a preferred embodiment of the invention only and not for the purpose of limiting same, FIG. 1 illustrates a snow plow and mount assembly 10 in accordance with the present invention. Snow plow and mount assembly 10 include a push bar assembly 20 and a snow plow assembly 60.

Figure 4:
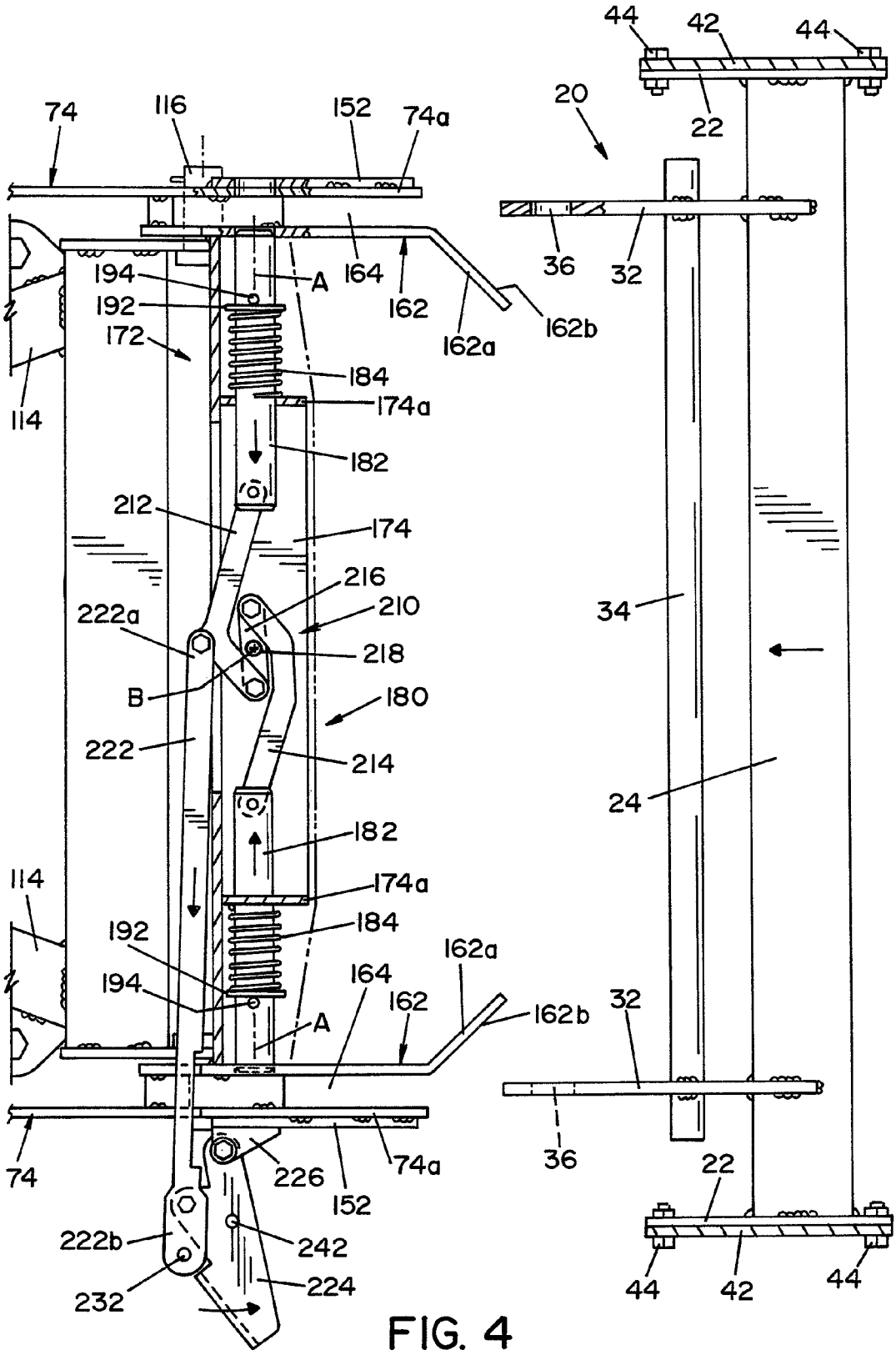
FIG. 4 is a view taken along line 4-4 of FIG. 3, showing a top plan view of a locking mechanism on the snow plow assembly.

Push bar assembly 20 is comprised of two spaced-apart mounting plates 22 that are connected by a transverse cross bracket 24. In the embodiment shown, mounting plates 22 are flat, rectangular plates, each having a plurality of apertures 26 formed therein. In the embodiment shown, cross bracket 24 is formed of rectangular tubing. Two spaced-apart receiver plates 32 extend from one side of cross bracket 24. Each receiver plate 32 is secured to cross bracket 24 to extend to a forward side thereof, as best seen in FIG. 4. A mounting bar 34 extends through the holes in receiver plate 32. Mounting bar 34 is attached to each receiver plate 32. In the embodiment shown, mounting bar 34 is in the form of a cylindrical rod. A circular opening 36 is formed in each receiver plate 32. Circular openings 36 in the spaced-apart receiver plates 32 are aligned along an axis that is parallel to mounting bar 34 and cross bracket 24.

Push bar assembly 20 is preferably formed of steel with cross bracket 24 being welded to mounting plates 22, and with receiver plates 32 welded to cross bracket 24 and to mounting bar 34.

Figure 5:
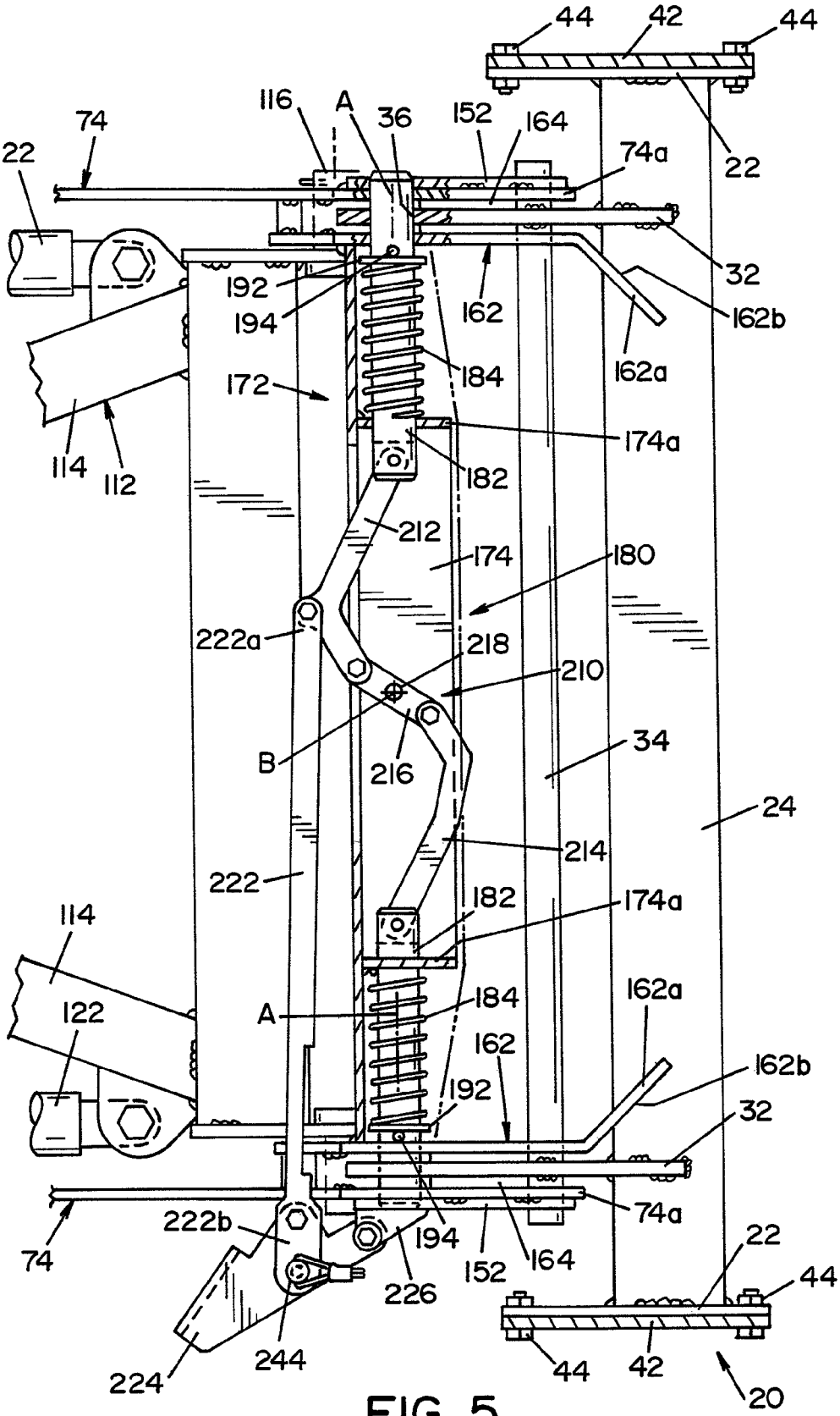
FIG. 5 is a sectional view taken along line 5-5 of FIG. 1, showing the locking mechanism in a locked position securing the snow plow assembly to the push bar assembly on the vehicle.

Push bar assembly 20 is designed to be attached to the support frame of a light-duty or medium-duty truck or SUV, designated 12 in FIG. 1. In the embodiment shown, vertical support plates 42 are attached to chassis 14 of vehicle 12. Push bar assembly 20 is mounted to support plates 42 using conventional bolts 44, as best seen in FIGS. 4 and 5.

Referring now to FIGS. 2-5, snow plow assembly 60 is best seen. Snow plow assembly 60 includes a lift frame 72, an A-frame 112, and a plow blade assembly 132. Lift frame 72 includes a pair of spaced-apart, upwardly extending supports 74 that are interconnected by laterally extending supports 76, 78 (shown in phantom in FIG. 1). In the embodiment shown, upwardly extending supports 74 are generally L-shaped and define a pair of rearward-extending arms 74*a*. Laterally extending support 76 of lift frame 72 supports a hydraulic motor 82 to supply hydraulic fluid to a hydraulic lift cylinder 84 that is also supported by the laterally extending support 76. Lift cylinder 84 is attached to a lift arm 86 that is pivotally connected to laterally extending support 78 at the upper end of lift frame 72. Chains 88 connect the free end of lift arm 86 to A-frame 112.

A-frame 112 includes two, rearward-extending legs 114 that are pivotally connected to rearward-extending arms 74*a* of lift frame 72 by means of horizontal pivot pins or bolts 116. Horizontal pins 116 permit pivoting of A-frame 112 about a generally horizontal axis.

The front end of A-frame 112 is pivotally connected to plow blade assembly 132. Plow blade assembly 132 includes a plow blade 134 having a replaceable scrapper blade 136 attached to the lower edge thereof. Plow blade 134 is attached to a structural frame 138 that in turn is connected to the front end of A-frame 112 about a generally vertical pivot bolt 142, wherein plow blade assembly 132 can pivot relative to A-frame 112 about a generally vertical axis. A-frame 112 further includes a pair of hydraulic cylinders 122 that are operably connected at one end to A-frame 112 and at another end to structural frame 138 for pivoting plow blade 134 about a generally vertical axis that is defined by pivot bolt 142.

The rearward-extending arms 74*a* of lift supports 74 are dimensioned to engage push bar 34 of push bar assembly 20. To this end, reinforcing plates 152 are attached to the outer surface of the free ends of arms 74*a* of supports 74. Supports 74 and reinforcing plates 152 are preferably formed of steel, and reinforcing plates 152 are preferably welded to support arms 74*a* to stiffen the same. A semi-circular recess 154 is formed in the free ends of reinforced arms 74*a* and reinforcing plates 152 to matingly receive and abut with cylindrical push bar 34 of push bar assembly 20. A pair of guide plates 162 is attached to arms 74*a* of supports 74, as best seen in FIG. 4. A guide plate 162 is spaced from the inner surface of a support arm 74*a* to define a slot 164 for receiving a receiver plate 32 of push bar assembly 20. Guide plates 162 have rearward-extending ends 162*a* that are bent inward toward each other to form a guide surface 162*b* for directing receiver plate 32 into slot 164, as shall be described in greater detail below.

A laterally extending support structure 172 extends between guide plate 162. Laterally extending support structure 172 is preferably welded to the inwardly-facing surfaces of guide plate 162. Support structure 172 includes a generally U-shaped support bracket 174, best seen in FIG. 6. Support bracket 174 includes two, spaced-apart, upwardly extending legs 174*a*. A locking mechanism 180 is mounted to support bracket 174 to attach the snow plow and mount assembly 10 to push bar assembly 20.

Locking mechanism 180 includes two axially-aligned locking pins 182. Each locking pin 182 is dimensioned to extend through aligned apertures in a leg 174*a* of support bracket 174, a guide plate 162, an arm 74*a* of support 74 and a reinforcing plate 152 on arm 74*a*. In the embodiment shown, locking pins 182 are aligned along a first axis, designated "A" in the drawings. Axis "A" is horizontal and parallel to the axis of push bar 34. Each locking pin 182 is biased outwardly along axis "A" by means of a helical compression spring 184. A locking pin 182 extends through a compression spring 184, as best seen in FIGS. 4 and 5. One end of a compression spring 184 abuts against the outer surface of a leg 174*a* of support bracket 174 and the other end of locking pin 182 abuts a washer 192 that is held in place by a pin 194 that extends transversely through a locking pin 182, as best seen in FIG. 4.

Figure 6:
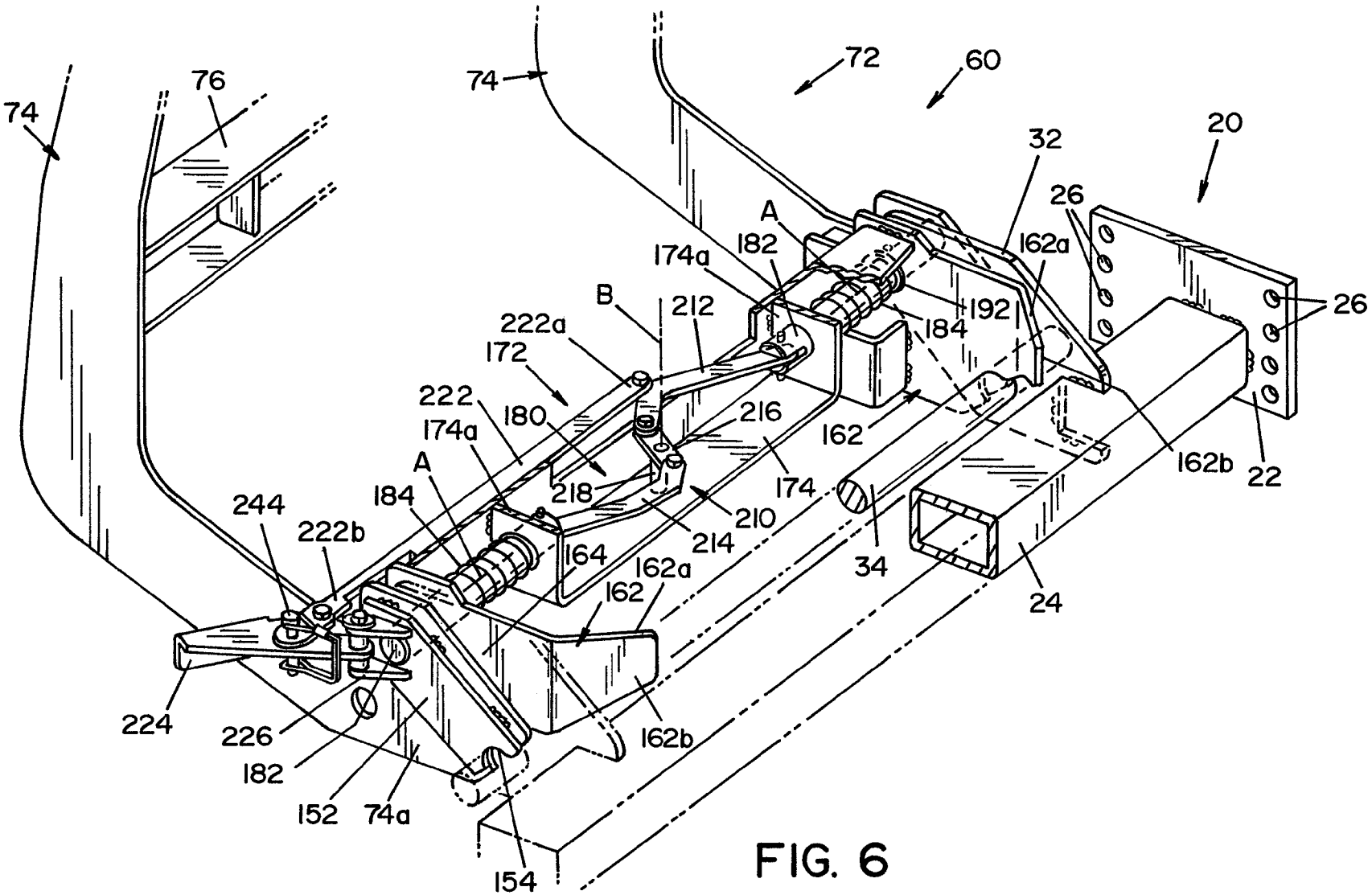
FIG. 6 is a partially-sectioned, perspective view of the locking mechanism in a locked position securing the plow assembly to the push bar assembly.

A linkage 210 connects the inner end of one locking pin 182 to the inner end of the other locking pin 182. Linkage 210 is comprised of two curved connecting arms 212, 214 and a lever 216. The outer end of each connecting arm 212, 214 is pinned to an inner end of a locking pin 182. The innermost end of each connecting arm 212, 214 is pinned to one end of lever 216, as shown in FIGS. 4, 5 and 6. Lever 216 is mounted to support bracket 174 for pivotal rotation. Pivot pin 218 is aligned along a second axis, designated "B." Axis "B" is generally perpendicular to axis "A." An elongated actuator arm 222 is connected to linkage 210. In this respect, one end 222*a* of actuator arm 222 is pivotally connected to connector arm 212. Actuator arm 222 is dimensioned to have a free end 222*b* that extends beyond the outer face of support arm 74, as best seen in FIGS. 4 and 5. Free end 222*b* of actuator arm 222 is connected to a pedal 224. Pedal 224 is pivotally attached to a bracket 226 that in turn is attached to the outer face of reinforcing plate 152 on support 74. Pedal 224 is pivotal about an axis that is parallel to axis "B." Rotational movement of pedal 224 causes actuator arm 222 to move linkage 210. Rotation of linkage 210 causes locking pins 182 to move along axis "A" wherein the outer ends of locking pins 182 extend through the apertures in guide plates 162 and in arms 74*a* of supports 74. In this respect, locking pins 182 extend through slots 164 defined between guide plates 162 and an adjacent arm 74*a* of support 74.

Locking mechanism 180 is movable between a first position and a second position. Referring now to FIG. 4, locking mechanism 180 is shown in a first position. When locking mechanism 180 is in the first position, locking pins 182 are in a "retracted position." As shown in FIG. 4, the outer ends of locking pins 182 are positioned within the apertures in guide plates 162, but do not extend into slots 164 defined between guide plates 162 and arms 74*a* of support arm 74. In this position, compression spring 184 is in a compressed state, being compressed between arm 174*a* of support bracket 174 and washer 192. Pedal 224, that is attached to actuator arm 222, is rotated to its furthest position in a counter-clockwise direction, when viewed from above, as illustrated by the arrow in FIG. 4. As shown in the drawings, because of the curved shape of connector arms 212, 214, lever 216 is located at an "over-center" position, wherein a centerline drawn between a pin connecting a connector arm 212 to lever 216 and a pin connecting connector arm 214 to lever 216 is slightly oblique to the axis of locking pins 182. As a result of the over-center position of lever 216, outward-biasing force exerted on linkage 210 by compression springs 184 is directed along a line that is canted relative to the axis of locking pins 182. In other words, the centerline of lever 216 is rotated past the point where the biasing force of springs 184 would force locking pins 182 outwardly, away from each other. In this position, the force of spring 184 exerts a counter-clockwise torque (when viewed from above) on lever 216. This "over-center" position maintains locking pins 182 in the retracted position.

The over-center position of lever 216 can be overcome by exerting a force against pedal 224 in a direction opposite to the arrow in FIG. 4, i.e., in a clockwise direction. Once sufficient force is applied to pedal 224 to cause the position of connector arms 212, 214 and lever 216 to rotate beyond the "over-center" position, locking mechanism 180 moves to the second position, best seen in FIG. 5. The biasing force of compression springs 184 causes locking pins 182 to extend outwardly through the apertures in guide plates 162 and arms 74*a* of supports 74, so as to extend through slot 164 formed therebetween. As will be appreciated by those skilled in the art, once the "over-center" position of linkage 210 is passed, locking pins 182 snap out into their extended positions, best seen in FIG. 5.

As best seen in FIG. 4, the outermost end of actuator arm 222 includes an aperture 232. Aperture 232 in actuator arm 222 is dimensioned to align with an aperture 242 in pedal 224 when pedal 224 is in the position shown in FIG. 5.

Aperture 232 in actuator arm 222 aligns with aperture 242 in pedal 224 to allow a locking pin 244, shown in FIG. 5, or a conventional lock (not shown), to extend through the aligned apertures 232, 242 to secure linkage 210 and locking mechanism 180 in the second position.

Figure 3:
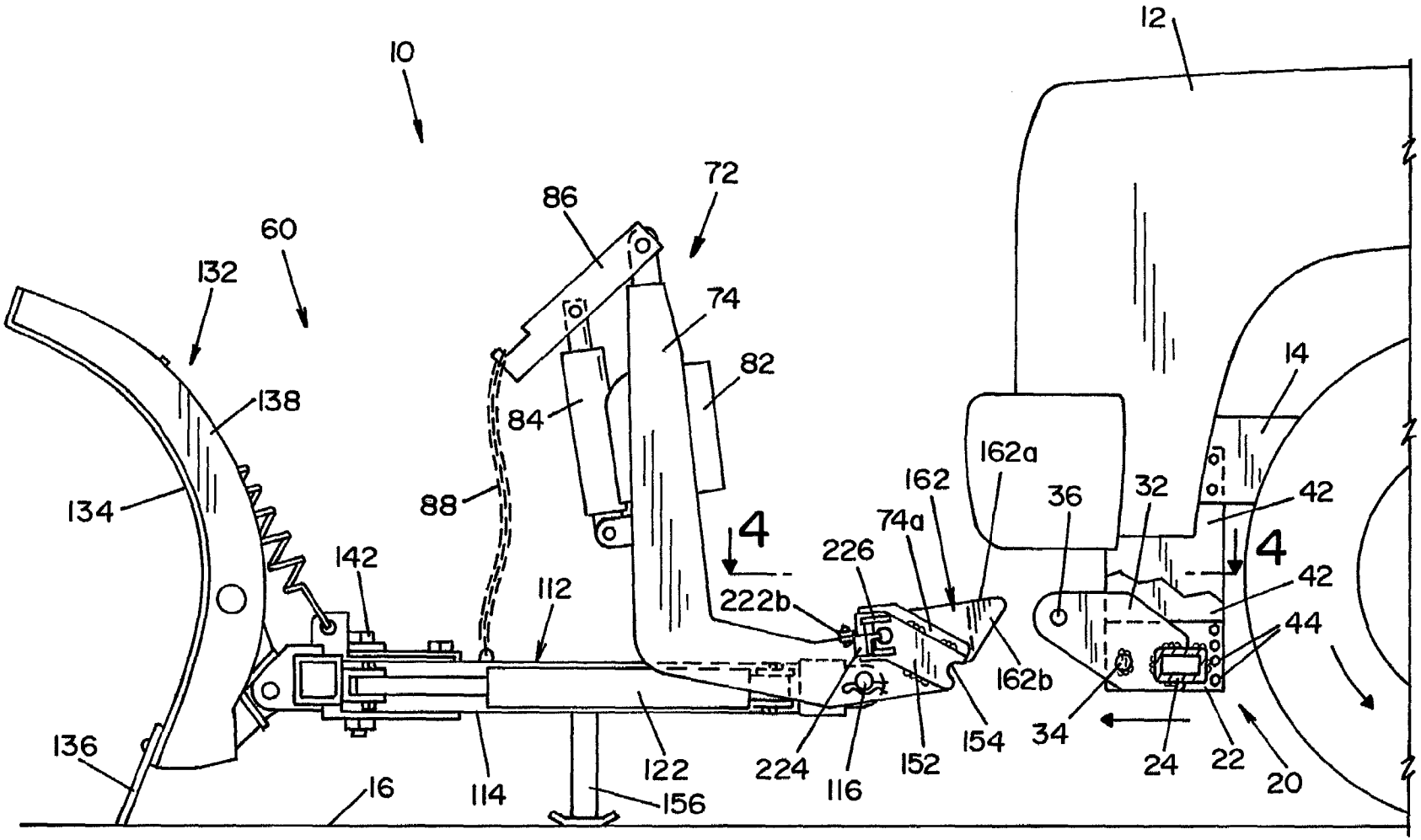
FIG. 3 is a side elevational view of a snow plow assembly positioned for mounting to a push bar assembly that is attached to a vehicle.

Referring now to FIG. 3, the present invention shall now be further described with respect to the operation thereof. FIG. 3 shows snow plow and mount assembly 10 set on a surface 16 of a road bed with a push vehicle 12 spaced therefrom. Snow plow and mount assembly 10 basically rests upon scraper blade 136 and support legs 156 that are attached to a frame 112. In this position, the semi-cylindrical notch in the free end of arms 74*a* of supports 74 are generally vertically aligned with push bar 34 of push bar assembly 20. Locking mechanism 180 and linkage 210 are in their first positions, best seen in FIG. 4, wherein locking pins 182 are retracted from slots 164. With linkage 210 in its first position, vehicle 12 is moved forward until push bar 34 is received within semi-circular recesses 154 in the free ends of arms 74*a*. As best seen in FIG. 3, the free ends of arms 74*a* are tapered to facilitate mating of push bar 34 with the semi-circular recesses 154. At the same time as push bar 34 moves toward semi-circular recesses 154 in arms 74*a*, receiver plates on push bar assembly 20 are directed into slots 164 defined between arms 74*a* and guide plates 162. Guide surfaces 162*b* on ends 162*a* of guide plates 162 assist in aligning receiver plates 32 within slots 164. Openings 36 and receiver plates 32 are disposed relative to push bar 34 such that openings 36 are generally vertically and horizontally aligned with the apertures through guide plates 162 and reinforced arms 74*a* when push bar 34 is received within semi-circular recesses 154.

As indicated above, the over-center position of linkage 210 maintains locking pins 182 in a retracted, first position during the alignment and engagement between snow plow and mount assembly 10 and push bar assembly 20.

When openings 36 in receiver plates 32 are aligned with the apertures in guide plates 162 and arms 74*a*, pedal 224 is rotated clockwise when viewed from above by exerting clockwise force to pedal 224, by either an operator's hand or foot. Rotation of pedal 224 in a clockwise direction causes actuator arm 222 to move inwardly thereby causing linkage 210 to rotate clockwise, when viewed from above. Once linkage 210 moves beyond the over-center position, compression springs 184 force locking pins 182 outwardly through the apertures in guide plates 162, through openings 36 in receiver plates 32, and through the apertures through reinforced arms 74*a*, thereby locking snow plow and mount assembly 10 to push bar assembly 20. As indicated above, once linkage 210 passes the center position, locking pins 182 snap outwardly into the second position, shown in FIG. 5, thereby locking snow plow and mount assembly 10 to push bar assembly 20. In accordance with one aspect of the present invention, linkage 210, when in its first position as shown in FIG. 4, is only slightly over-center. In this respect, relatively little force is required to overcome the biasing force exerted by compression springs 184. In this respect, linkage 210 is designed such that linkage 210 can overcome its over-center position even in the event that openings 36 in receiver plates 32 are slightly misaligned with the apertures in guide plates 162 and arms 74*a*. In this respect, if the openings 36 and apertures through guide plates 162 and arms 74*a* are misaligned, linkage 210 can still be rotated to where locking pins 182 are biased outwardly by compression springs 184 such that the outer ends of locking pins 182 engage the inner surfaces of receiver plates 32*a*. When in this position, slight, relative movement of snow plow and mount assembly 10 relative to push bar assembly 20 may be sufficient to align the openings 36 and the corresponding apertures, in which case, locking pins 182 will snap into the extended locking position shown in FIG. 5.

The present invention thus provides a snow plow mount and locking assembly for quick and easy attachment and detachment of a snow plow and mount assembly 10 to a push bar assembly 20. Moreover, both locking pins 182 are simultaneously operable by a single pedal 224 that is disposed to one side of snow plow and mount assembly 10. Still further, by positioning locking pins 182 and linkage 210 internally between supports 74, such components are less likely to be damaged due to contact with objects external to snow plow and mount assembly 10.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. A locking assembly for locking a plow onto a push beam on a vehicle, said push beam having two spaced-apart receiver plates extending therefrom, said plates each having an aperture therethrough, said locking assembly comprised of:

a mounting frame that is attachable to the back side of a plow assembly, said mounting frame having spaced-apart mounting plates, each of said mounting plates having an aperture therethrough, each of said mounting plates being designed to be positionable adjacent one of said receiver plates with said aperture in said receiver plate in vertical and horizontal alignment with said aperture in said mounting plate; and a locking mechanism for locking said mounting frame to said push beam, said locking assembly having a pair of axially-aligned, spaced-apart locking pins biased outwardly away from each other along a first axis, each of said locking pins having an inner and an outer end;

a linkage connected to the inner ends of said locking pins, said linkage being movable between a first position and a second position and being operable to simultaneously move said locking pins along an axis, wherein said pins are in a retracted position along said axis when said linkage is in said first position, and are in an extended position along said axis when said linkage is in said second position, each of said locking pins extending through said aperture in one of said receiving plates and through said aperture in one of said mounting plates when said aperture in said receiving plate and said aperture in said mounting plate are horizontally and vertically aligned and when said linkage is in said second position, and each of said locking pins being removed from said aperture in said receiving plate and from said aperture in said mounting plate when said linkage is in said first position, said linkage being in an over-center position when said linkage is in said first position; and an actuator arm operable to move said linkage between said first position and said second position, said actuator arm having a first end connected to said linkage and a free end that extends beyond a side of said mounting frame.

2. A locking assembly as defined in claim 1, wherein said locking assembly is mounted to said mounting frame.

3. A locking assembly as defined in claim 1, wherein said mounting frame includes spaced-apart pairs of mounting plates, each pair of mounting plates defining a slot for receiving a receiver plate on said push beam, each mounting plate in a pair of mounting plates having an aperture therethrough, said aperture in each of said pair of mounting plates being vertically and horizontally alignable with in one of said receiver plates when said receiver plate is disposed in said slot.

4. A locking assembly as defined in claim 1, wherein said linkage is comprised of:

a lever pivotable about a second axis disposed between said locking pins, and a pair of connector arms, each connector arm having a first end pivotally connected to the inner end of one of said locking pins and a second end connected to an end of said lever, wherein rotation of said lever about said second axis causes said connecting arms to move said locking pins along said first axis.

5. A locking assembly as defined in claim 4, wherein said second axis is perpendicular to said first axis.

6. A locking assembly as defined in claim 4, wherein said first ends of said connector arms are pinned to said locking pin.

7. A locking assembly as defined in claim 4, wherein said actuator arm is connected to one of said connecting arms.

8. A locking assembly as defined in claim 7, wherein said actuator arm includes a pedal lever at one end to move said actuator arm.

9. A locking assembly as defined in claim 1, wherein said locking assembly is disposed between said mounting plates.

10. A coupling for a plow, comprising:

a push beam attachable to a front of a vehicle, said push beam having at least one outwardly-extending plate at each end thereof each plate having an aperture extending therethrough;

a support frame that is attachable to the back side of a plow assembly, said support frame having two spaced-apart mounting plates extending therefrom, each of said mounting plates having an aperture therethrough, each of said mounting plates dimensioned to be positionable adjacent one of said plates on said push beam with said aperture in said plate and said aperture in said mounting plate being aligned; and a locking assembly for locking said support frame to said push beam, said locking assembly comprised of:

a pair of axially aligned pins biased outwardly away from each other, each of said pins having an inner end and an outer end, a linkage connecting the inner ends of said pins, said linkage having a first position wherein said pins are retracted toward each other along a first axis, and a second position wherein said pins extend outwardly away from each other along said first axis, said linkage being in an over-center position when said linkage is in said first position; and an actuator arm operable to move said linkage between said first position and said second position, said actuator arm having a first end connected to said linkage and a free end that extends beyond a side of said support frame.

11. A locking assembly as defined in claim 10, wherein said linkage is comprised of:

a lever pivotable about a second axis disposed between said locking pins, and a pair of connector arms, each connector arm having a first end pivotally connected to the inner end of one of said locking pins and a second end connected to an end of said lever, wherein rotation of said lever about said second axis causes said connecting arms to move said locking pins along said first axis.

12. A locking assembly as defined in claim 11, wherein said second axis is perpendicular to said first axis.

13. A locking assembly as defined in claim 11, wherein said first ends of said connector arms are pinned to said locking pin.

14. A locking assembly as defined in claim 10, wherein said actuator arm is connected to one of said connecting arms.

15. A locking assembly as defined in claim 14, wherein said actuator arm includes a pedal lever at one end to move said actuator arm.

* * * * *